United States Patent [19]

Wilgosz

[11] Patent Number: 4,509,650

[45] Date of Patent: Apr. 9, 1985

[54] COMBINED FIREWOOD RACK AND FUMIGATOR

[76] Inventor: Robert Wilgosz, 1000 Crestmont Ave., Mantua, N.J. 08051

[21] Appl. No.: 493,623

[22] Filed: May 11, 1983

[51] Int. Cl.[3] ..... A47F 5/00

[52] U.S. Cl. ..... 211/60.1; 43/132.1; 211/49.1

[58] Field of Search ..... 211/60 R, 49 R, 182; 126/298, 164; D23/138.5, 138.4; 239/289, 57, 60; 43/132.1

[56] References Cited

U.S. PATENT DOCUMENTS

| | | | |
|---|---|---|---|
| D. 243,504 | 3/1977 | Morrison | D23/138.5 |
| 984,352 | 2/1911 | Costello | 239/57 |
| 3,021,011 | 2/1962 | Visneski | 211/49 R |
| 3,187,901 | 6/1965 | Wilson | 211/60 R |
| 3,216,585 | 11/1965 | Whittle | 211/60 R |
| 3,269,383 | 8/1966 | Maasberg | 126/164 |
| 3,612,287 | 10/1971 | Maltese | 211/182 X |
| 3,945,498 | 3/1976 | Lampinen | 211/60 R |
| 4,223,818 | 9/1980 | Johnson | 211/60 R |

*Primary Examiner*—Robert W. Gibson, Jr.
*Attorney, Agent, or Firm*—Duffield & Lehrer

[57] ABSTRACT

A firewood rack includes a reservoir for containing a quantity of a fumigant and slowly releases the vapors upwardly through the firewood to kill or repel insects or other pests. The rack includes at least one tubular member which supports the firewood. Fumigant granules are poured into the interior of the tubular member through a fill opening therein. Vapors are released through a plurality of holes in the wall of the tubular member.

20 Claims, 5 Drawing Figures

COMBINED FIREWOOD RACK AND FUMIGATOR

BACKGROUND OF THE INVENTION

The present invention is directed toward a firewood rack and more particularly toward a firewood rack which is capable of not only supporting a plurality of logs or other pieces of firewood but which simultaneously and continuously fumigates the wood in order to prevent infestation of insects, rodents or other pests.

Apparently as a result of the high costs of heating fuels, home fireplaces, heating stoves and the like have increased significantly in popularity over the past several years. While most homeowners who utilize their fireplace may store a large quantity of firewood at some location remote from their house, they usually also maintain a smaller quantity of wood closer to the house at a more convenient location. This, of course, creates the problem of attracting insects, rodents and other pests which utilize the pile of firewood for either breeding places or food too close to the house.

Firewood racks have been utilized for many years as one means for reducing the above problem. These racks are made in a variety of different shapes and sizes, some examples of which are shown in U.S. Pat. Nos. 3,187,901; 4,223,818; 4,236,775 and 4,294,364, and support the firewood above ground level. As a result, the wood stays relatively dry and is substantially less susceptible to infestation by certain insects.

Many other insects and other pests, however, continue to infest the firewood sitting in a firewood rack. These insects are, thus, close to the outside of the house in the area around the firewood and can be brought into the house when the firewood is carried in to be burned. This can be not only unpleasant but also dangerous since many of the insects such as termites can cause substantial damage to a structure.

To Applicant's knowledge, no one has ever attempted to further attack the problem of preventing infestation of insects, rodents or other pests from a woodpile. While pesticide dispensers per se are known such as shown in U.S. Pat. Nos. 984,352 and 3,098,703, no one has ever proposed to combine the same with a firewood rack.

SUMMARY OF THE INVENTION

The present invention overcomes the problems of pest infestation in firewood by providing a firewood rack which includes a reservoir for containing a quantity of a fumigant and slowly releases the vapors upwardly through the firewood to kill or repel insects or other pests. The rack includes at least one tubular member which supports the firewood. Fumigant granules are poured into the interior of the tubular member through a fill opening therein. Vapors are released through a plurality of holes in the wall of the tubular member.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
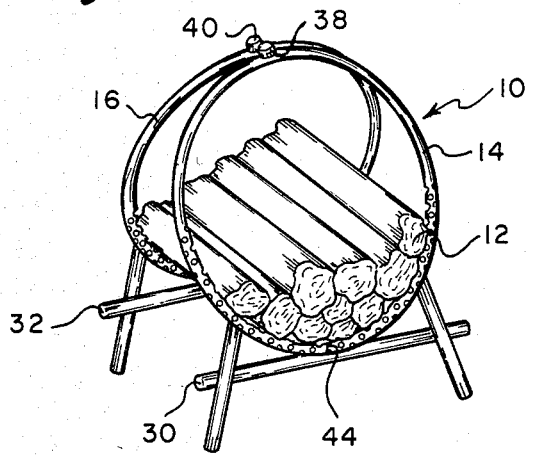
FIG. 1 is a perspective view of a combined firewood rack and fumigator constructed in accordance with the principles of the present invention and shown supporting a plurality of pieces of firewood.
Figure 2:
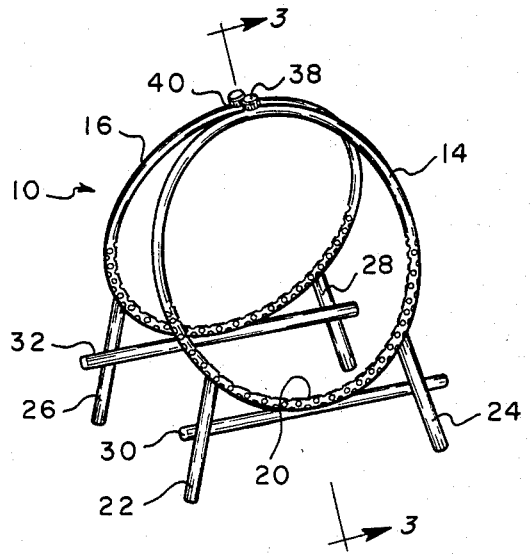
FIG. 2 is a view similar to FIG. 1 but showing the rack without the firewood being contained therein.

Referring now to the drawings in detail wherein like reference numerals have been used throughout the various figures to designate like elements, there is shown in FIG. 1 a combined firewood rack and fumigator constructed in accordance with the principles of the present invention and designated generally as 10. FIG. 1 illustrates the invention being utilized to support a plurality of logs or other pieces of firewood 12. A similar view of the combined firewood rack and fumigator 10 is shown in FIG. 2 but without the firewood being supported therein.

The firewood rack 10 includes a support frame comprised of two substantially circular hoops 14 and 16 which are joined together adjacent the tops thereof and which have their lower portions spread apart. As shown most clearly in FIG. 3, the hoops 14 and 16 are comprised of tubular metal having a substantially hollow interior 18. The firewood 12 is supported on the upper surface 20 of the lower portion of the hoops 14 and 16. Legs 22, 24, 26 and 28 support the hoops 14 and 16 on the ground and above ground level. Crossbars 30 and 32 provide structural rigidity to the rack.

Figure 3:
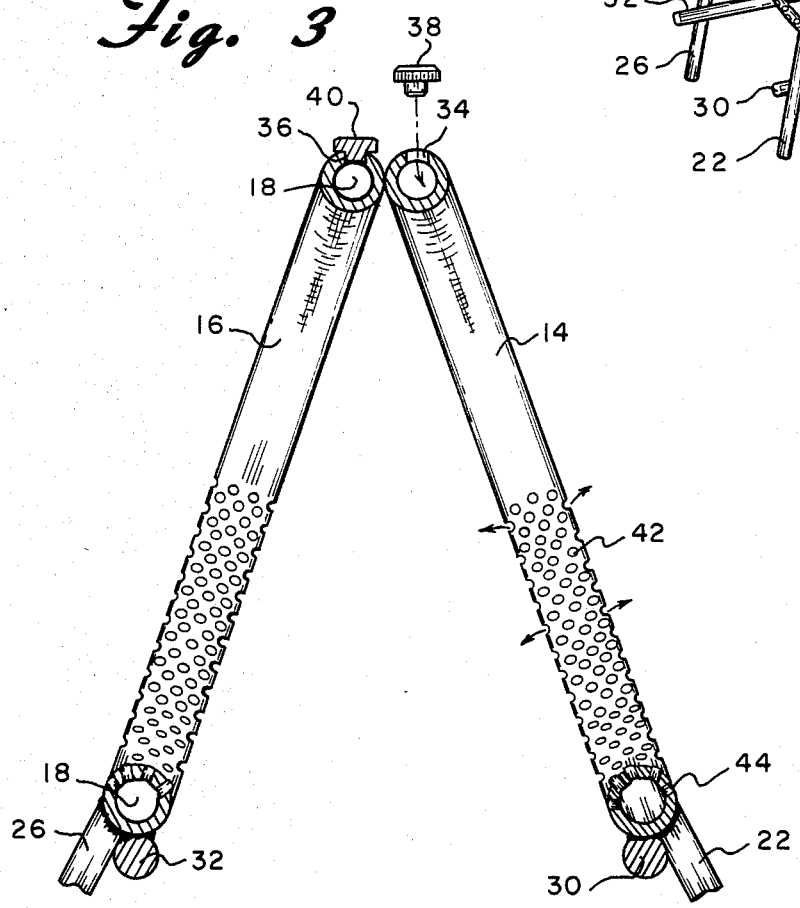
FIG. 3 is a cross-sectional view taken along the line 3—3 of FIG. 2.

Each of the hoops 14 and 16 includes a fill opening adjacent the top thereof as shown at 34 and 36 in FIG. 3. A granular, powdered or other fluent fumigant may be poured into the interior space 18 of the hoops 14 and 16 through the fill holes 34 and 36. Plugs 38 and 40 serve as closure means for closing the fill openings 34 and 36, respectively.

A plurality of holes 42 are formed in the tubular walls of the hoops 14 and 16 to provide communications between the interior 18 thereof and the exterior. These holes 42 are primarily located in the upper surface of the lower half of each of the hoops as is shown most clearly in FIG. 3. Holes formed in the undersurface of the lower portion of the hoops might allow the fumigant material to pass therethrough and would, therefore, be undesirable.

As should now be readily apparent, fumigant material poured into the interior 18 of the hoops 14 and 16 through fill openings 34 and 36 will fall to the lowermost portions of the hoops. From here, the fumes or vapors from the fumigant will pass out through the holes 42 onto and around the firewood 12. It should be noted that at least some of the holes 42 are arranged at an angle away from the vertical so that they will not be blocked or covered by the firewood 12 placed on the support frame. See, for example, hole 44 in FIGS. 1 and 3.

Figure 4:
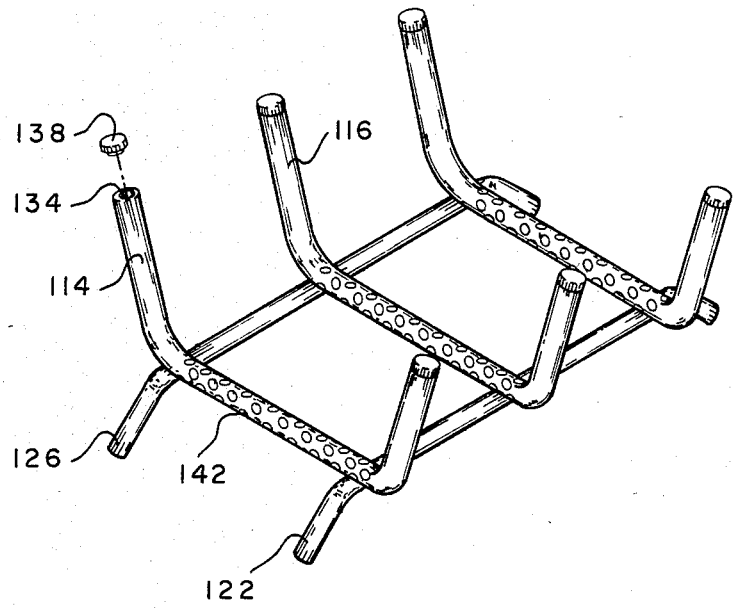
FIG. 4 is a perspective view of a second embodiment of the invention.

A second embodiment of the invention is shown in FIG. 4. In this embodiment, a plurality of U-shaped tubular members 114 and 116 having horizontal portions and vertically extending portions are utilized to support the firewood in lieu of the hoops 14 and 16. Legs 122 and 126 support the tubular members above ground level. Each tubular member includes a plurality of holes 142 passing through the wall thereof so as to provide communication between the interior of the tube and the exterior. End caps 138 serve as closure means for the open tubular ends 134 into which may be poured the fumigant material.

Figure 5:
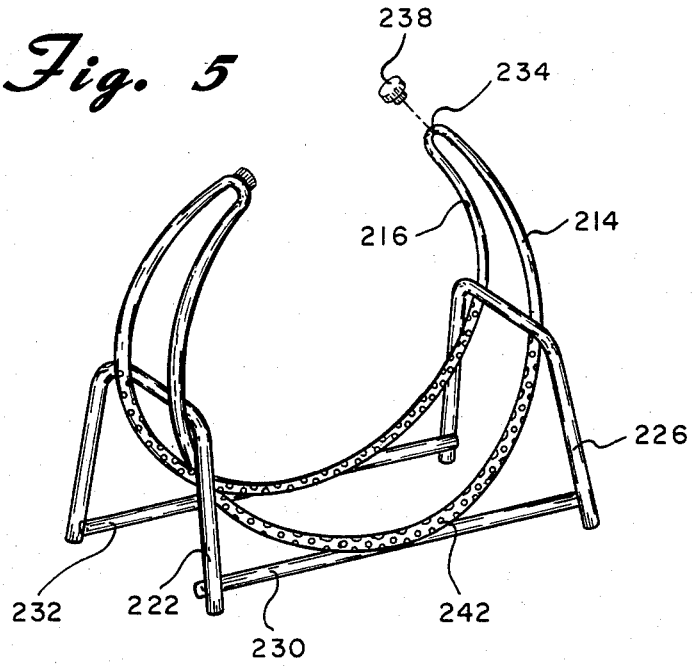
FIG. 5 is a perspective view of a still further embodiment of the present invention.

An even further embodiment of the invention is shown in FIG. 5. This embodiment is similar to the embodiment shown in FIGS. 1–3 but utilizes a single hoop of tubular metal which is bent in half to form a double hoop comprised of portions 214 and 216. The hoop portions 214 and 216 are supported above the ground by legs 222 and 226 and reinforcement supports 230 and 232. The hoop portions 214 and 216 are provided with a plurality of holes 242 in a manner similar to hoops 14 and 16 of FIG. 1. Fill holes 234 are formed in the upper portion of the rack at the bend between the hoop portions 214 and 216. This opening 234 may be closed by a plug or closure member 238.

The fumigant material utilized with the present invention is preferably in granular, powdered or other fluent form so that it can easily be introduced into one of the fill openings and flow freely down into the interior of the tubular members. It should be noted that the word "fumigant" is intended to cover a substance which gives off vapors or fumes which can pass through the openings in tubular members and which will function as a pesticide, insecticide or a repellent. In other words, for the purposes of the invention, it is not necessary that the insects or pests be actually killed as long as they are repelled and therefore prevented from infesting the wood. Examples of substances which may be used with the present invention are 2,2-dichlorovinyl 0,0-dimethyl phosphate; para-dichlorobenzene; benzyl benzoate; dimethyl phthalate or dimethyl carbate. Numerous other materials and combinations thereof could, of course, also be utilized.

The present invention may be embodied in other specific forms without departing from the spirit or essential attributes thereof and accordingly, reference should be made to the appended claims rather than to the foregoing specification as indicating the scope of the invention.

I claim:

1. A combined firewood rack and fumigator comprising:

a firewood support frame including at least one tubular member having an upper surface onto which may be placed a plurality of pieces of firewood for supporting the same;

means associated with said frame for supporting said frame on the ground;

said tubular member having a plurality of non-obstructed holes in the tubular wall thereof providing communication between the interior of said tubular member and the exterior thereof;

said tubular member also including a portion thereof extending vertically upwardly;

a fill opening in said tubular member adjacent the top of said vertical portion into which may be poured a fumigant while firewood is supported on said upper surface, and closure means for closing said fill opening.

2. The invention as claimed in claim 1 wherein at least some of said holes are situated in the lower portion of the support frame below the level of the firewood to be supported thereon.

3. The invention as claimed in claim 2 wherein at least some of said holes are arranged at an angle away from the vertical so as not to be blocked by firewood placed on said support frame.

4. The invention as claimed in claim 1 wherein said tubular member is circular in cross section.

5. The invention as claimed in claim 1 further including a fumigant located within said tubular member.

6. The invention as claimed in claim 5 wherein said fumigant is a pesticide.

7. The invention as claimed in claim 5 wherein said fumigant is an insecticide.

8. The invention as claimed in claim 5 wherein said fumigant is a repellent.

9. A combined firewood rack and fumigator comprising:

a firewood support frame including a support surface for supporting a plurality of pieces of firewood thereon and at least one substantially vertically extending rigid member for maintaining said firewood on said support surface;

reservoir means containing a supply of a fumigant, and means for dispensing vapors from said fumigant out of said reservoir at a point which is at or below the level of said support surface.

10. The invention as claimed in claim 9 wherein said means for dispensing vapors includes a plurality of holes in said reservoir providing communication between the interior and the exterior thereof.

11. The invention as claimed in claim 9 wherein said fumigant is a pesticide.

12. The invention as claimed in claim 9 wherein said fumigant is an insecticide.

13. The invention as claimed in claim 9 wherein said fumigant is a repellent.

14. A combined firewood rack and fumigator comprising:

a firewood support frame including at least one tubular member having an upper surface onto which may be placed a plurality of pieces of firewood for supporting the same;

a plurality of legs extending downwardly from said frame for supporting said frame on the ground;

said tubular member having a plurality of holes in the tubular wall thereof providing communication between the interior of said tubular member and the exterior thereof;

a fumigant located within said tubular member;

a fill opening in said tubular member into which may be poured additional fumigant, and closure means for closing said fill opening.

15. The invention as claimed in claim 14 wherein at least some of said holes are situated in the lower portion of the support frame below the level of the firewood to be supported thereon.

16. The invention as claimed in claim 15 wherein at least some of said holes are arranged at an angle away from the vertical so as not to be blocked by firewood placed on said support frame.

17. The invention as claimed in claim 14 wherein said tubular member is circular in cross section.

18. The invention as claimed in claim 14 wherein said fumigant is a pesticide.

19. The invention as claimed in claim 14 wherein said fumigant is an insecticide.

20. The invention as claimed in claim 14 wherein said fumigant is a repellent.

* * * * *